US006151741A

United States Patent [19]

Chen

[11] Patent Number: 6,151,741

[45] Date of Patent: Nov. 28, 2000

[54] TOOL HOLDER

[76] Inventor: Martin Chen, P.O. Box 63-247, Taichung, Taiwan

[21] Appl. No.: 09/346,524

[22] Filed: Jul. 2, 1999

[51] Int. Cl.[7] ..... B67B 7/00

[52] U.S. Cl. ..... 7/155; 7/165

[58] Field of Search ..... 7/154, 155, 165; 81/125, 177.4, 439

[56] References Cited

U.S. PATENT DOCUMENTS

| | | | |
|---|---|---|---|
| 1,453,979 | 5/1923 | Holsen | 7/165 |
| 3,683,984 | 8/1972 | Hull | 81/177.4 |
| 4,644,831 | 2/1987 | Yang | 81/125 |
| 4,759,238 | 7/1988 | Farfalli | 81/3.09 |
| 5,499,562 | 3/1996 | Feng | 81/177.4 |

*Primary Examiner*—James G. Smith
*Assistant Examiner*—David B. Thomas
*Attorney, Agent, or Firm*—Charles E. Baxley

[57] ABSTRACT

A tool holder includes a main body having a compartment and a recess defined therein. The main body further includes a bit holder formed on an end thereof. A bit holding plate is removably received in the compartment of the main body and releasably holds at least one bit thereon. The bit can be releasably held in place by the bit holder. A cork remover is pivotally connected to the main body and movable between a storage position in the recess and an operative position outside the recess. A cap is provided to house the bit holder to provide an aesthetically pleasing effect.

8 Claims, 13 Drawing Sheets

TOOL HOLDER

BACKGROUND OF THE INVENTION

1. Field of the Invention

The present invention relates to a tool holder that may provide an aesthetically pleasing effect in addition to holding tools, and more particularly to a tool holder that may receive a corkscrew in a manner that the corkscrew is hidden when not in use, thereby preventing injury to individuals.

2. Description of the Related Art

FIG. 12 of the drawings illustrates a conventional cork remover that includes a main body having two arms 80 pivotally connected to two sides thereof, a screw 62 extended longitudinally through the main body, a corkscrew 61 secured to a lower end of the screw 62, a grip 60 secured to an upper end of the screw 62, and a mouth engaging member 70 integral with the main body. When in user, the mouth engaging member 70 is placed to house the mouth of the bottle to be opened, the screw 62 is swiveled by operating the grip 60 until the corkscrew 61 pierces into the cork of the bottle to a certain depth, while the arms 80 are pivoted upward to a horizontal position via transmission of two gears 81 formed on ends of the arms 80. The aims 80 are then manually pivoted downward and the cork is lifted and thus removed from the bottle. FIG. 13 illustrates a corkscrew 90 that has a handle attached thereto for manual operation. However, the corkscrews in both designs are exposed and thus might cause injury to children and incautious users.

The present invention is intended to provide a tool holder that mitigates and/or obviate the above problems.

SUMMARY OF THE INVENTION

It is a primary object of the present invention to provide a tool holder that may receive tools when not in use and may act as a handle when in use.

It is a second object of the present invention to provide an aesthetically pleasing tool holder.

A cork remover in accordance with the present invention comprise a main body including a recess defined therein and a cork remover pivotally connected to the main body and movable between a storage position in the recess and an operative position outside the recess.

The present invention also provides a combination of a tool holder and bits. The tool holder comprises:

a main body including a compartment and a recess defined therein, the main body further including a bit holder formed on an end thereof;

a bit holding plate removably received in the compartment of the main body and releasably holding at least one bit thereon, said at least one bit being releasably held in place by the bit holder; and a cork remover pivotally connected to the main body and movable between a storage position in the recess and an operative position outside the recess.

The bit holder includes a hexagonal hole defined therein. An inner periphery defining the hexagonal hole includes two grooves, and a U-shaped spring has two limbs received in the grooves for retaining the bit in the hexagonal hole.

The bit may be a screwdriver bit or a bit of a hexagonal wrench.

The main body includes a fixed seat having a pivotal section for pivotally engaging with an end of a corkscrew of the cork remover. The pivotal section of the fixed seat includes two spaced plates for pivotally sandwiching the end of the corkscrew.

A wall defining the compartment includes a pair of groove tracks defined therein, and the bit holding plate includes two extended edges slidably received in the groove tracks.

The bit holding plate may include a grip for manual operation. A cap may be removably mounted to the end of the main body to house the bit holder. The cap includes a receptacle having an inner threading for engaging with a threaded section of the main body.

In accordance with a preferred embodiment of the invention, the tool holder comprises:

a main body including a compartment and a recess defined therein, the main body further including a bit holder formed on an end thereof;

a bit holding plate removably received in the compartment of the main body and releasably holding a plurality of different bits, one of said bits to be used being releasably held in place by the bit holder;

a corkscrew pivotally connected to the main body and movable between a storage position in the recess and an operative position outside the recess; and a stopper pivotally connected to the main body and movable between a storage position in the recess and an operative position outside the recess.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
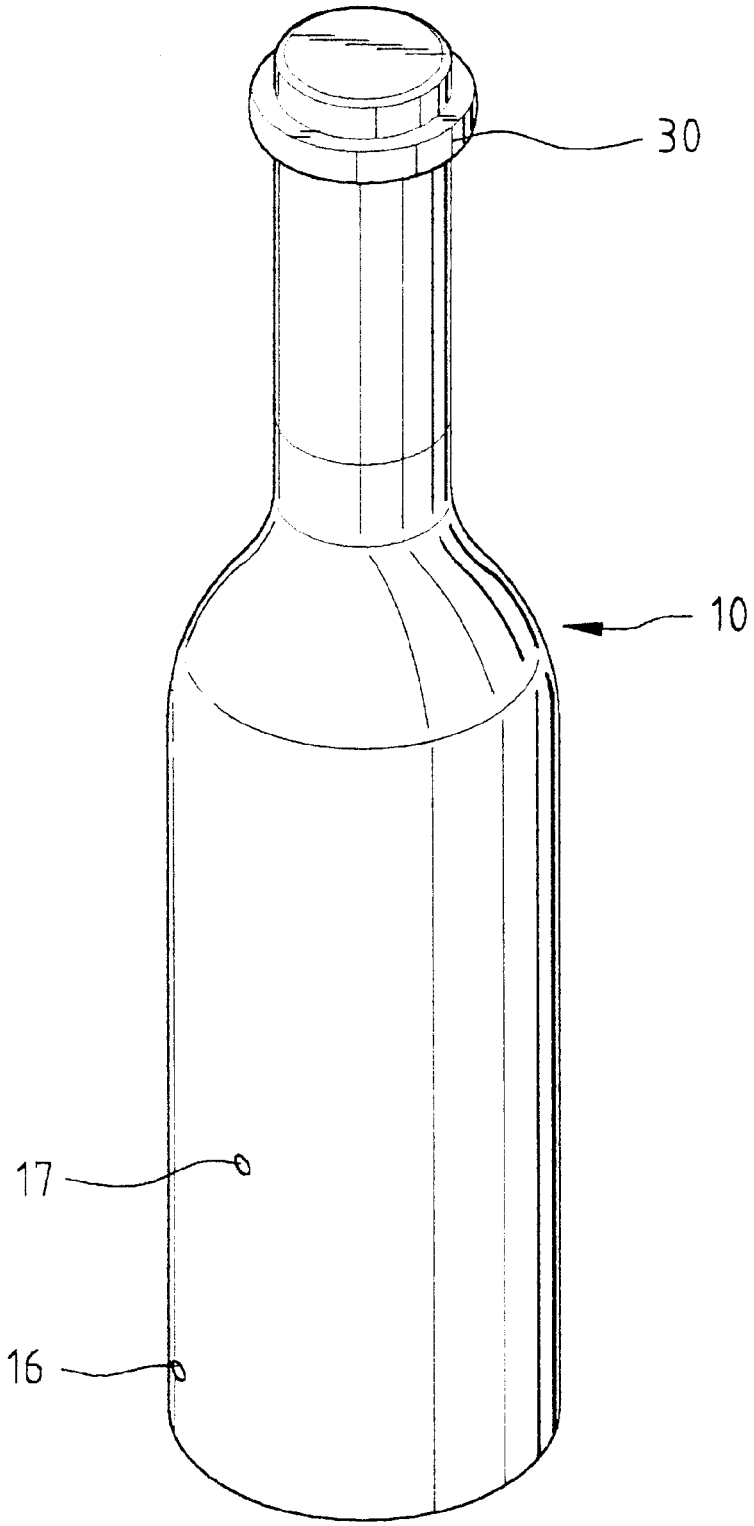
FIG. 1 is a perspective view of a tool holder in accordance with the present invention.
Figure 2:
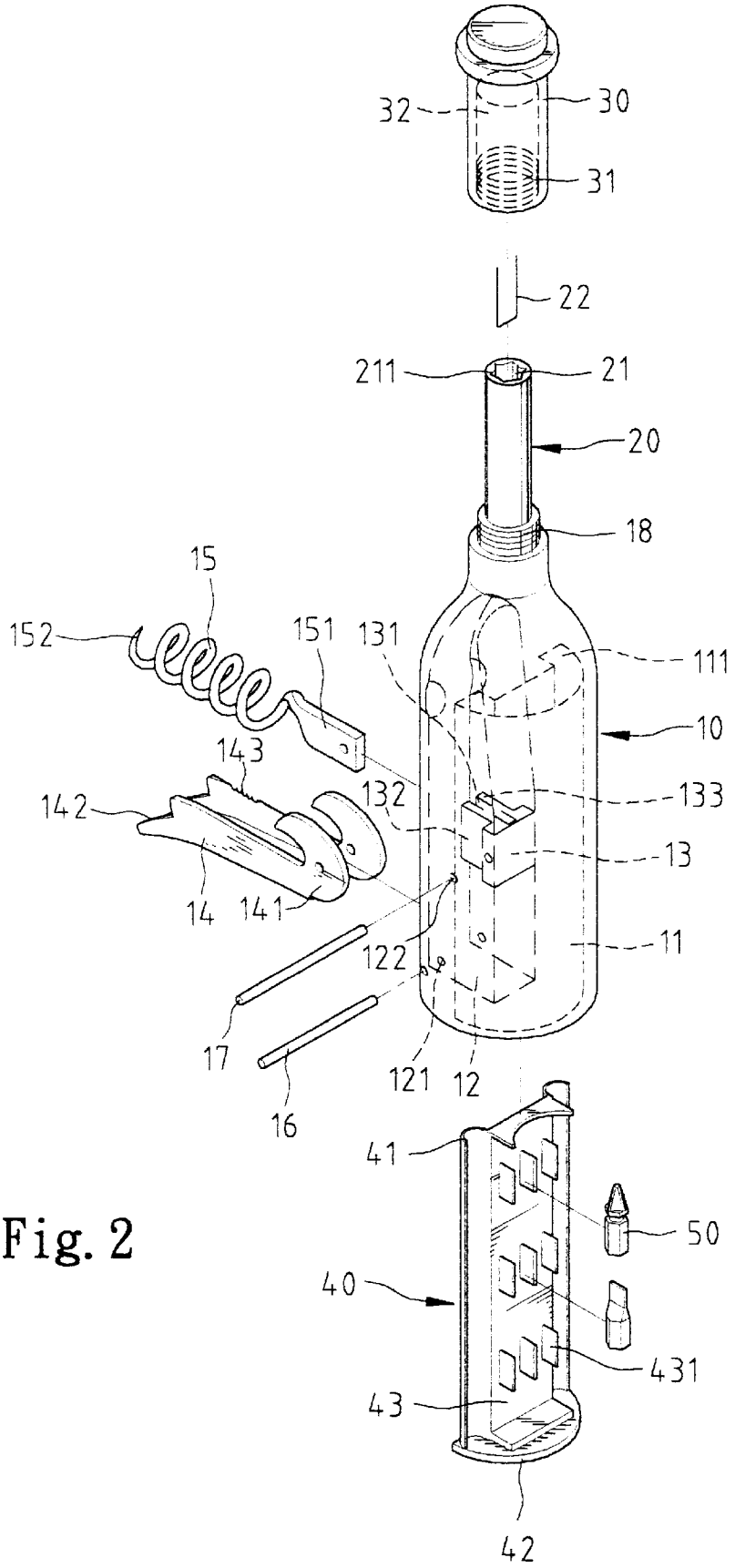
FIG. 2 is an exploded perspective view of the tool holder in accordance with the present invention.
Figure 3:
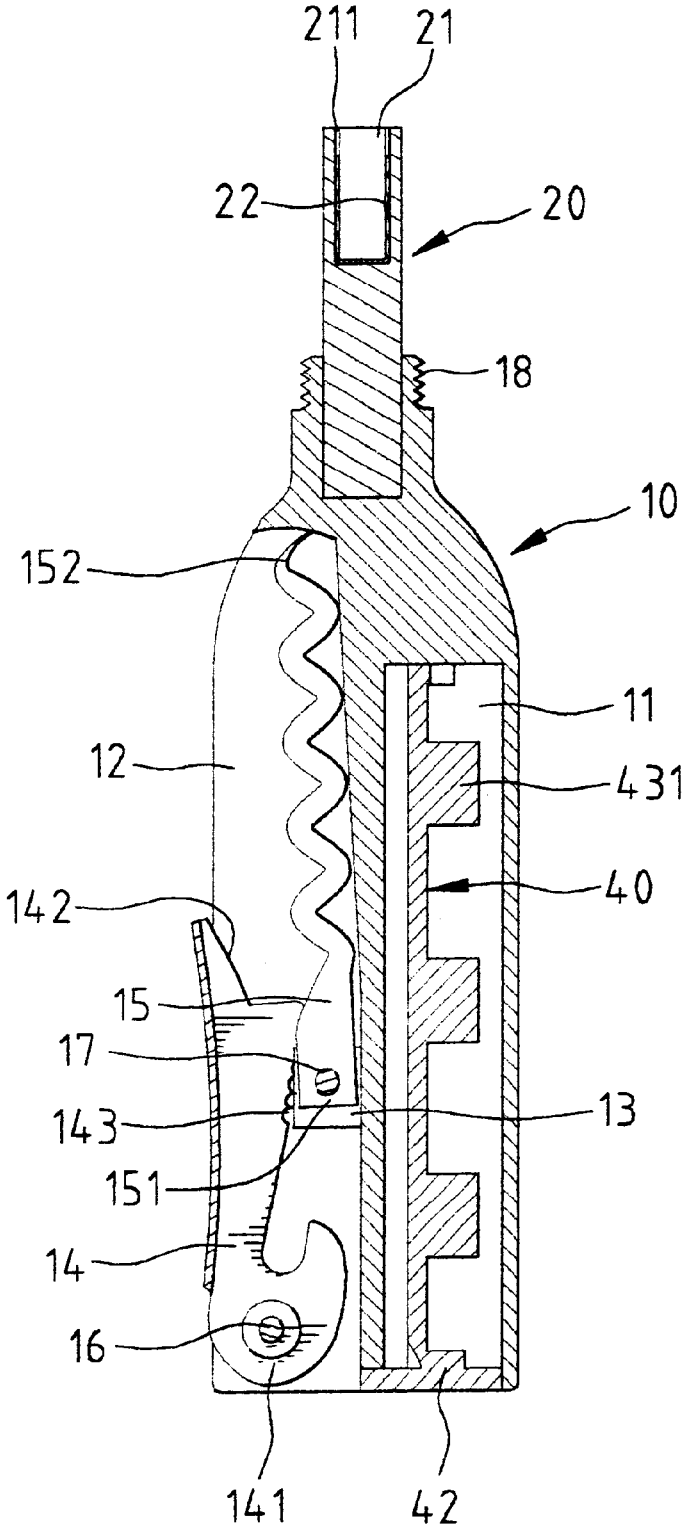
FIG. 3 is a sectional view of the tool holder in accordance with the present invention, wherein the cap of the tool holder is removed for clarity.

Referring to FIGS. 1 through 11 and initially to FIGS. 1 through 3, a tool holder in accordance with the present invention generally includes a main body 10 that has a compartment 11 and a recess 12 defined therein. The compartment 11 is communicated with outside via an opening (not labeled) in a bottom of the main body 10. A wall that defines the compartment 11 includes a pair of groove tracks 111. A fixing seat 13 is secured in the recess 12 and includes a pivotal section 131 consisting of two spaced plates 131. An upper end of the main body 10 includes a threaded section 18 and a bit holder 20 projected from the threaded section 18. A hexagonal hole 21 is defined in the bit holder 20 and a periphery defining the hexagonal hole 21 includes two aligned grooves 211 defined therein. A substantially U-shaped spring 22 has two limbs (not labeled) received in the grooves 211 for retaining a bit 50 (FIG. 4) in place.

A bit holding plate 40 is removably received in the compartment 11 of the main body 10 and includes a pair of extended edges 41 that are slidably engaged in the groove tracks 111. The bit holding plate 40 includes a receiving section 43 having a number of spaced retaining pieces 431 for holding bits 50 (e.g., screwdriver bits and/or bits for hexagonal wrenches) therebetween. A grip 42 is formed on an end of the bit holding plate 40 for manual operation of insertion into or removal from the compartment 11 of the main body 10.

A stopper 14 includes an end 141 pivoted to the main body 10 by means of extending a pin 16 through a pin hole 121 in the main body 10 and a pin hole (not labeled) in the end 141. The stopper 14 further includes a toothed section 143 in a mediate portion thereof. The stopper 14 may be pivotable between a storage position in the recess 12 of the main body 10 and an operative position wherein the other end 142 is outside the recess 12.

A corkscrew 15 has a first end 151 pivoted to the pivotal section 131 of the fixed seat 13 by means of extending a pin 17 through a pin hole 122 in the main body 10 and pin holes (not labeled) in the first end 151 and the fixed seat 13. The corkscrew 15 may be pivotable between a storage position in the recess 12 of the main body 10 and an operative position wherein the second end 152 is outside the recess 12.

A cap 30 is provided to house the bit holder 20. The cap 30 includes an inner threading 31 in a receptacle 32 thereof for engaging with the threaded section 18 of the main body 18.

Figure 9:
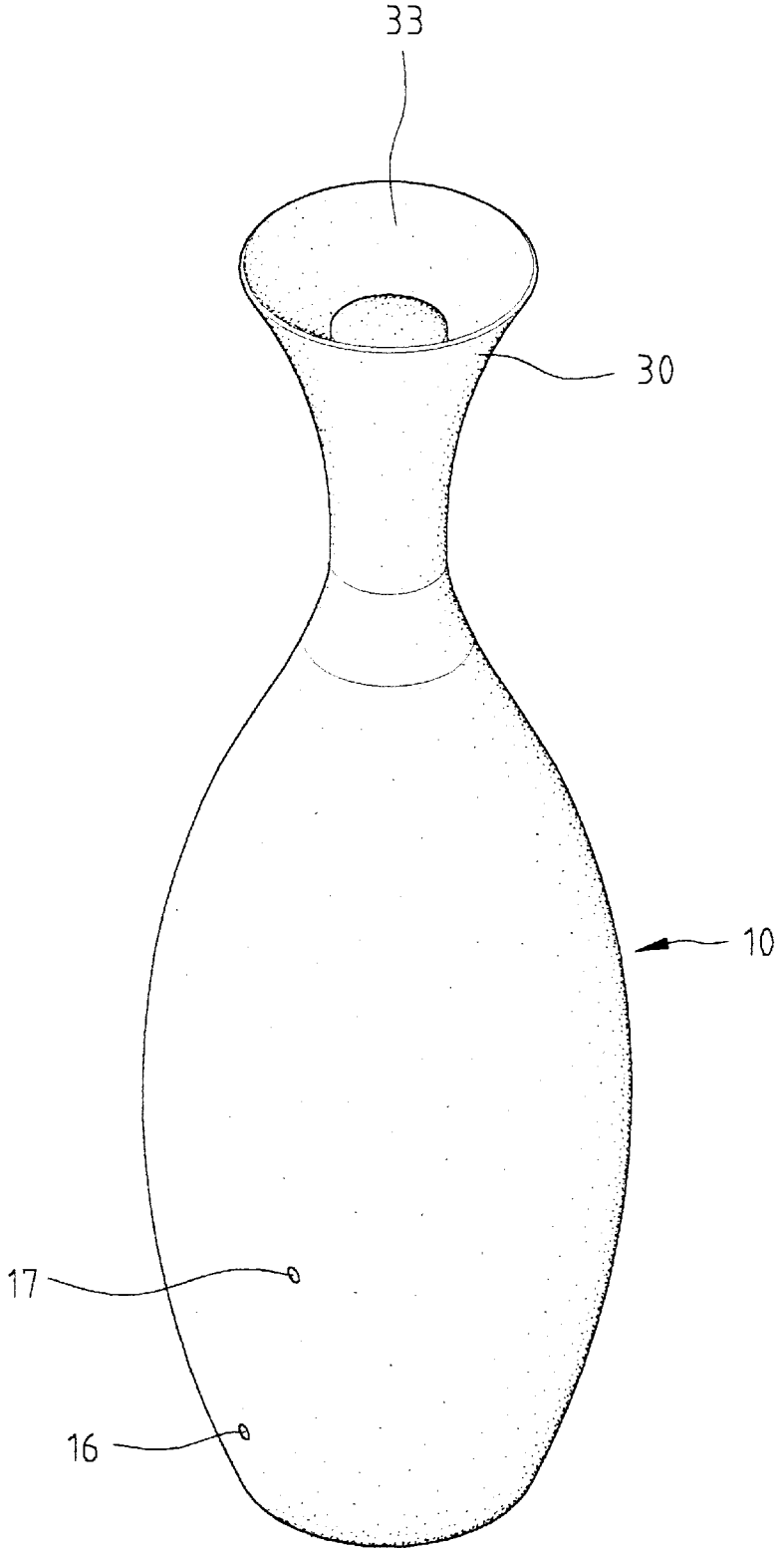
FIG. 9 is a perspective view of a modified embodiment of the tool holder in accordance with the present invention.
Figure 10:
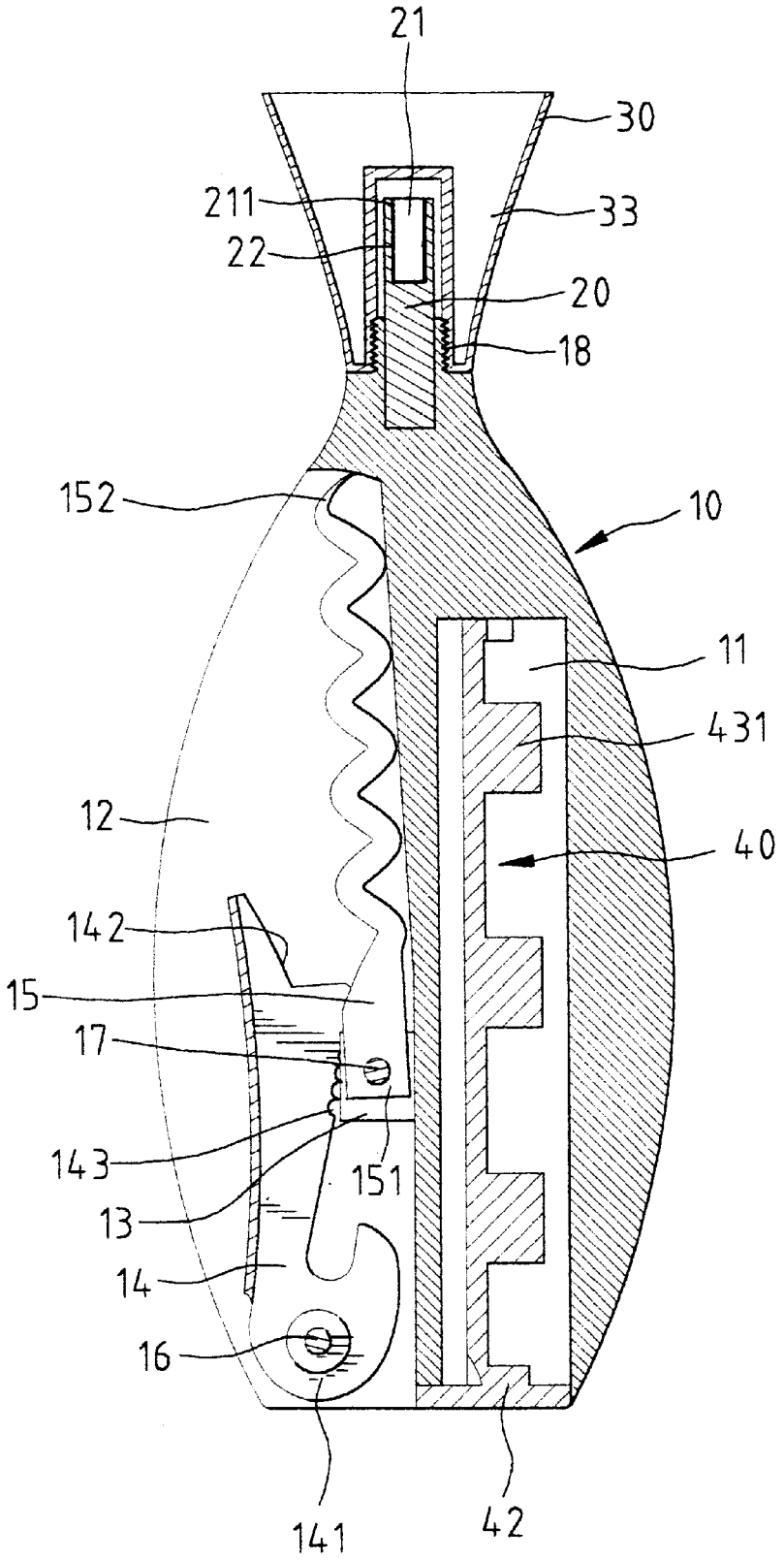
FIG. 10 is a sectional view of the tool holder in FIG. 9.
Figure 11:
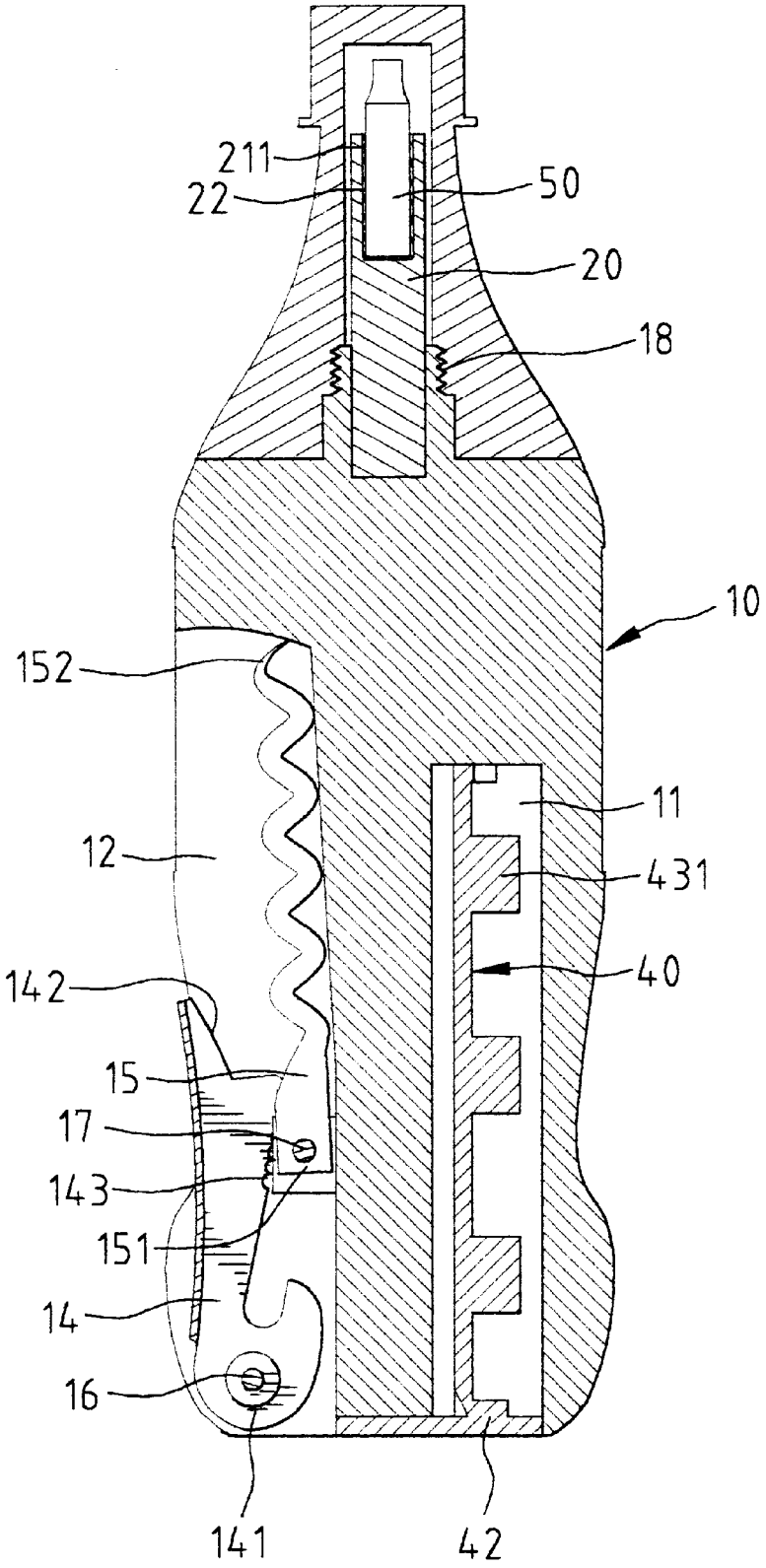
FIG. 11 is a sectional view of another modified embodiment of the tool holder in accordance with the present invention.
Figure 12:
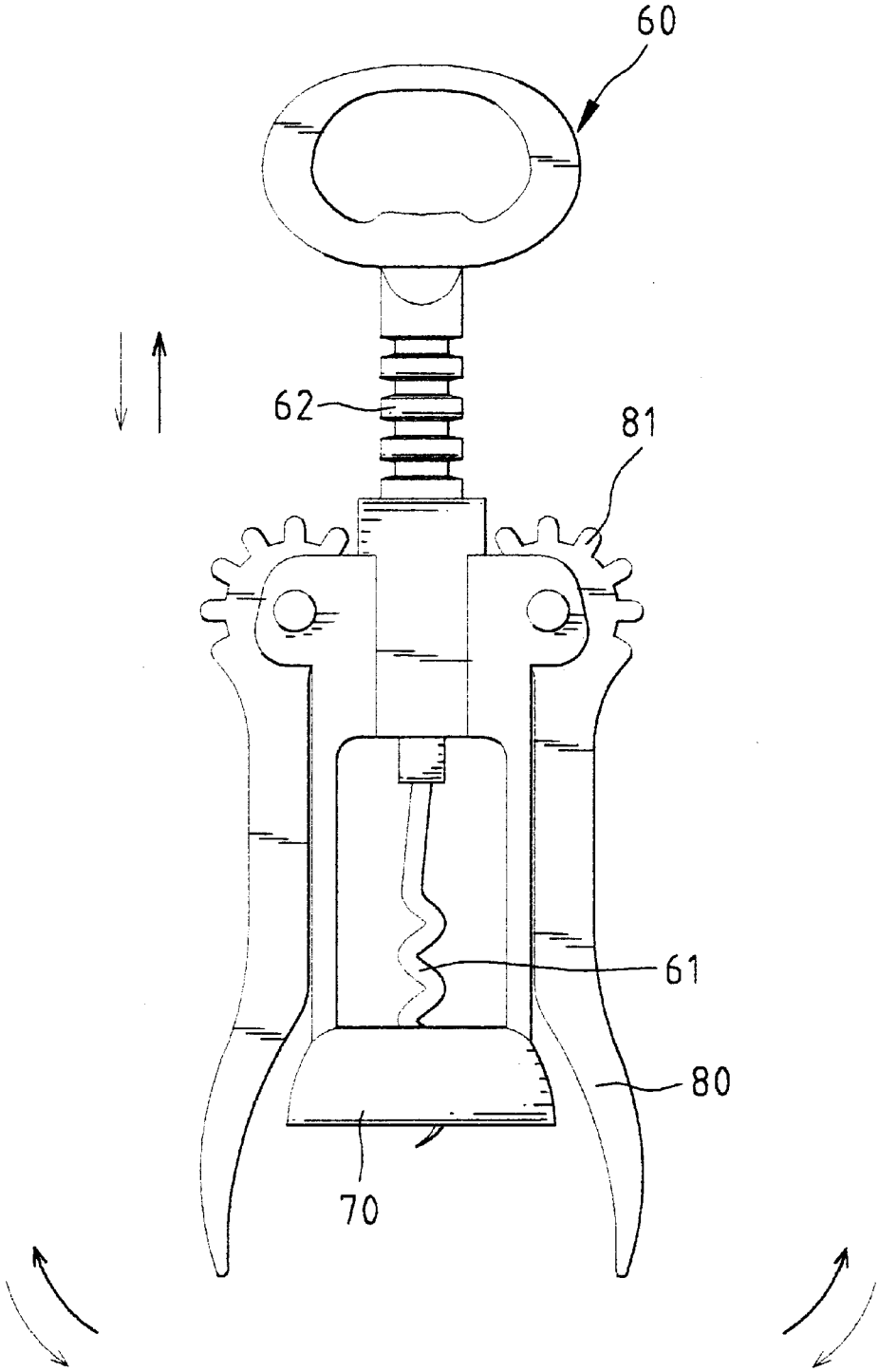
Fig. 12 PRIOR ART
FIG. 12 is a perspective view of a conventional cork remover.
Figure 13:
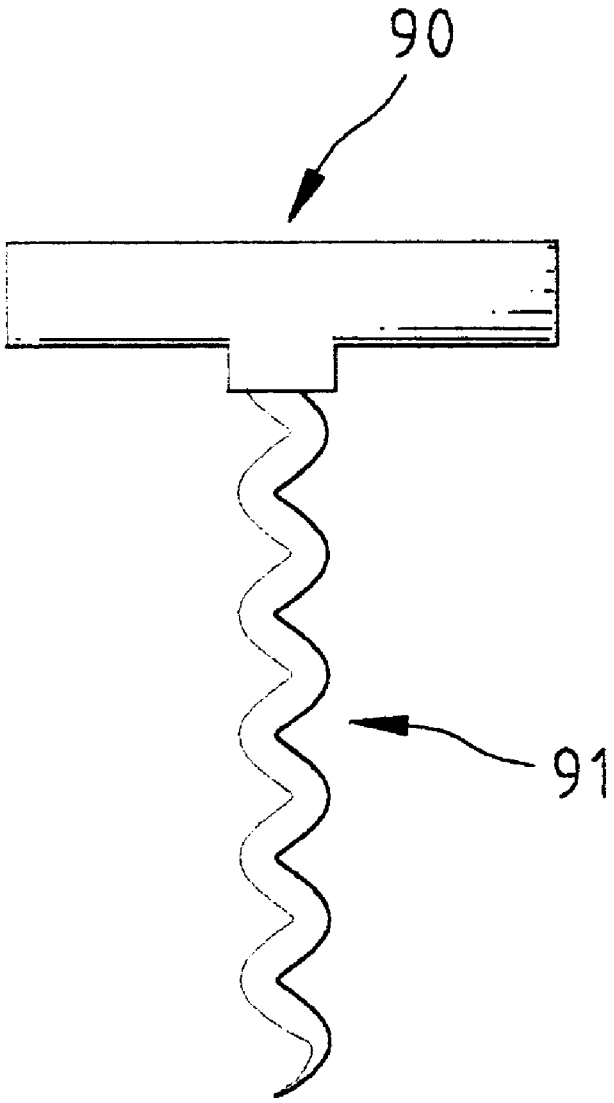
Fig. 13 PRIOR ART
FIG. 13 is a perspective view of a conventional corkscrew.

The bit holding plate 40 may have a plurality of different bits 50 held thereon. When not in use, the bit holding plate 40 is received in the compartment 11 of the main body 10, while the corkscrew 15 and the stopper 14 are received in the recess 12 of the main body 10, as shown in FIG. 3. Thus, potential injury to children and users is avoided. The toothed section 143 of the stopper 14 frictionally engages with the first end 151 of the corkscrew 15 to retain the stopper 14 and the corkscrew 15 in place. In addition, the tool holder as a whole may provide an aesthetically pleasing effect (FIG. 1). FIGS. 9 and 10 illustrate a modified embodiment in the cap 30 that includes a space 33 for flowering. FIG. 11 illustrates another modified embodiment in the cap (now designated by 60) of a different shape.

Figure 4:
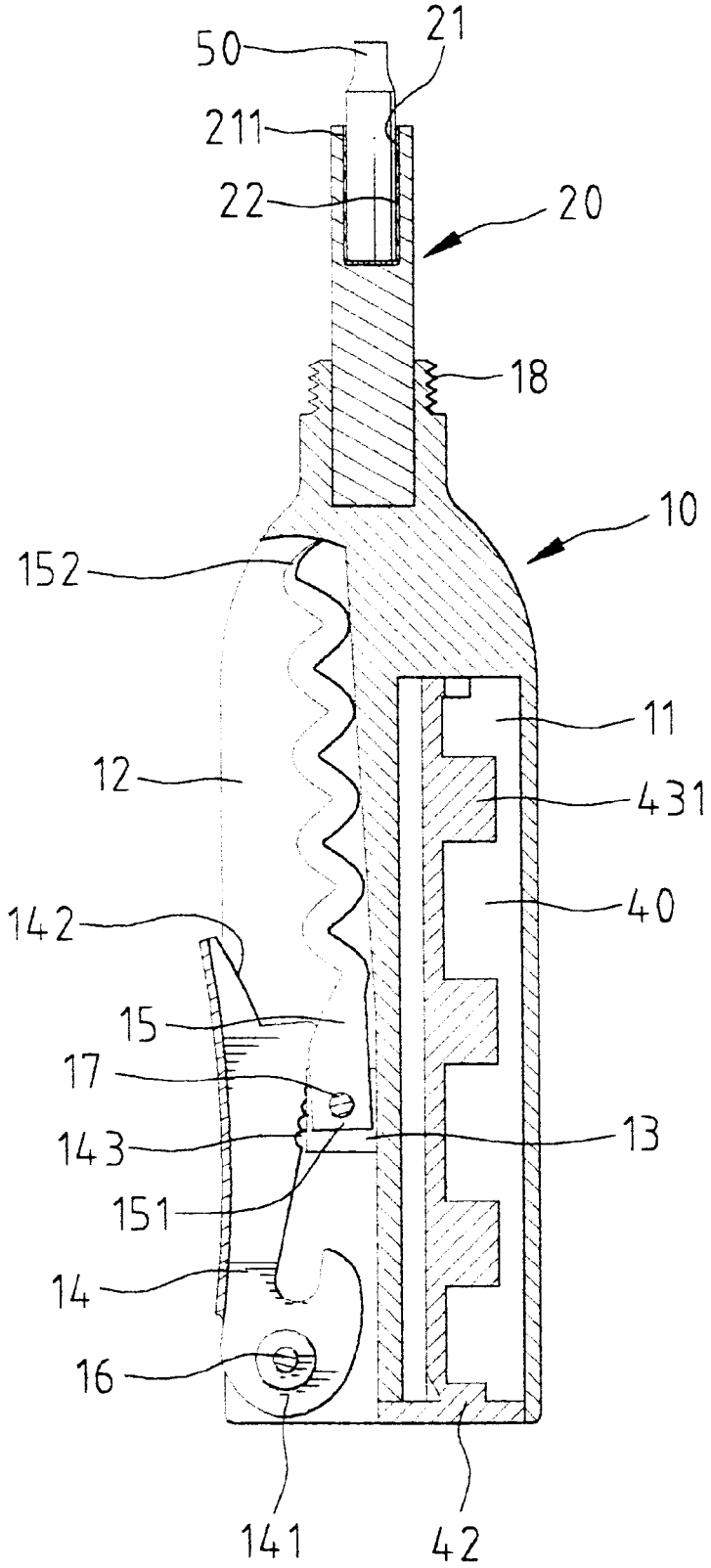
FIG. 4 is a sectional view similar to FIG. 3, wherein a bit is attached to the tool holder.
Figure 5:
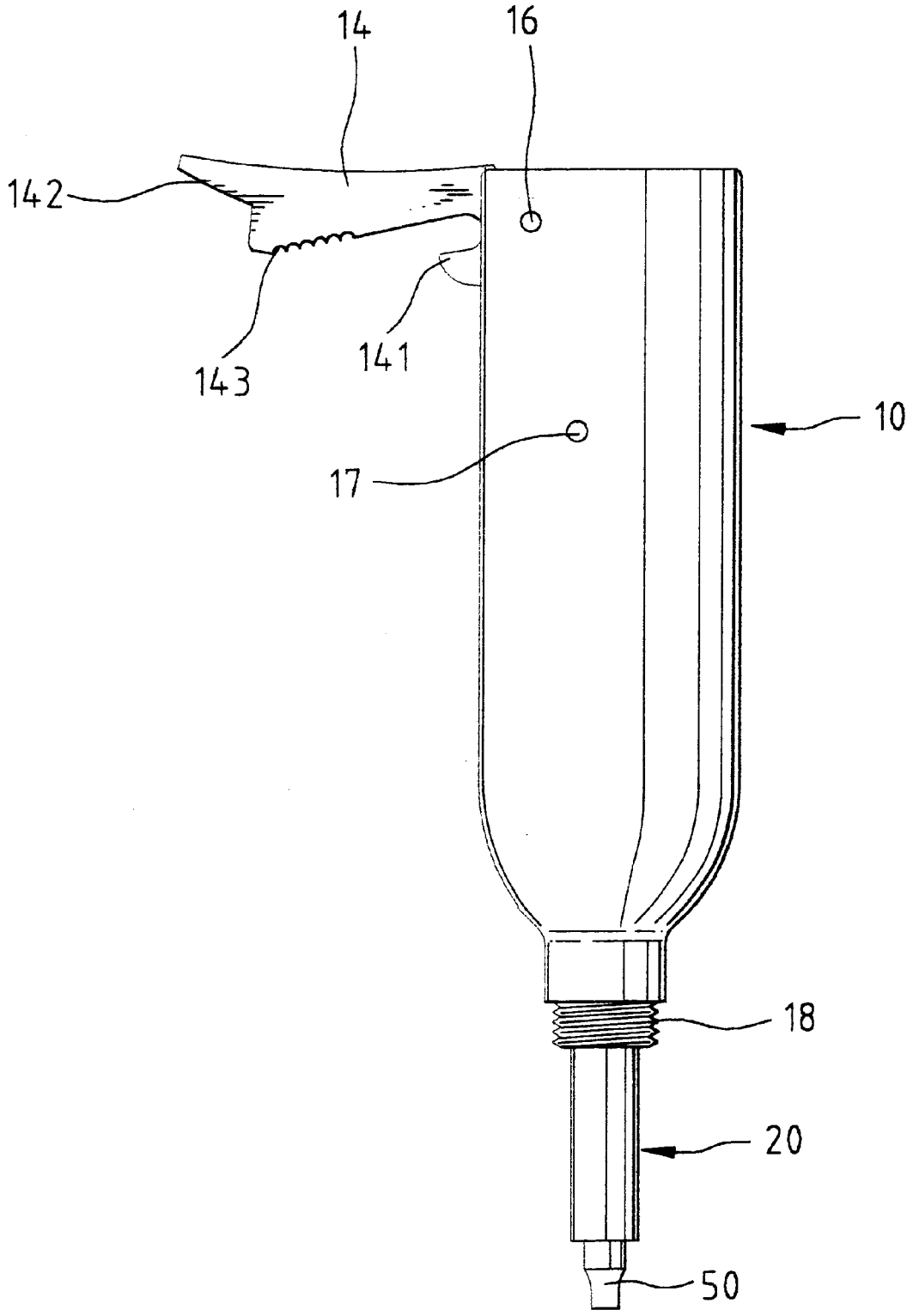
FIG. 5 is a side view illustrating use of the tool holder in FIG. 4.
Figure 6:
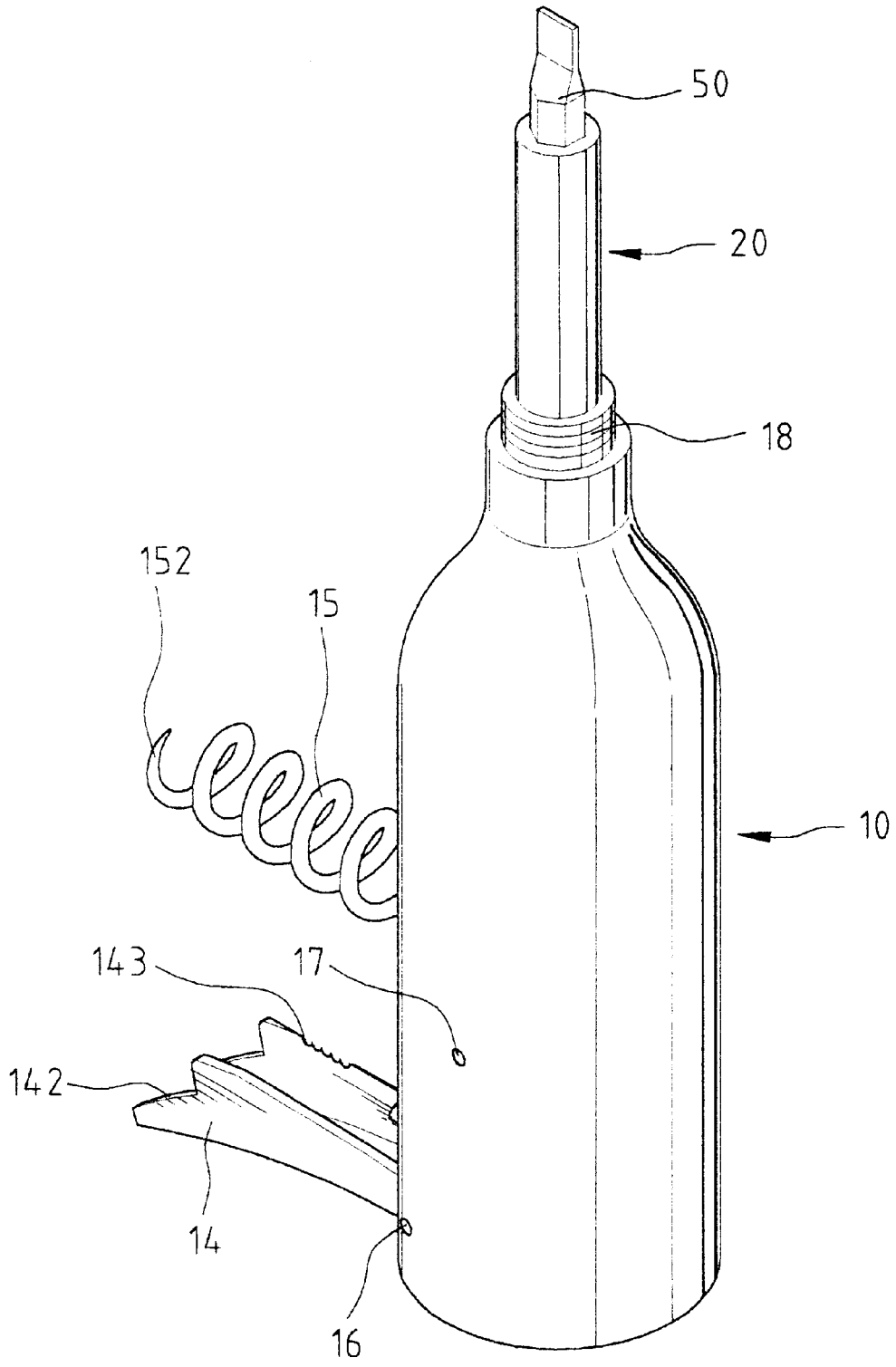
FIG. 6 is a perspective view of the tool holder with the cork remover in an operative position.
Figure 7:
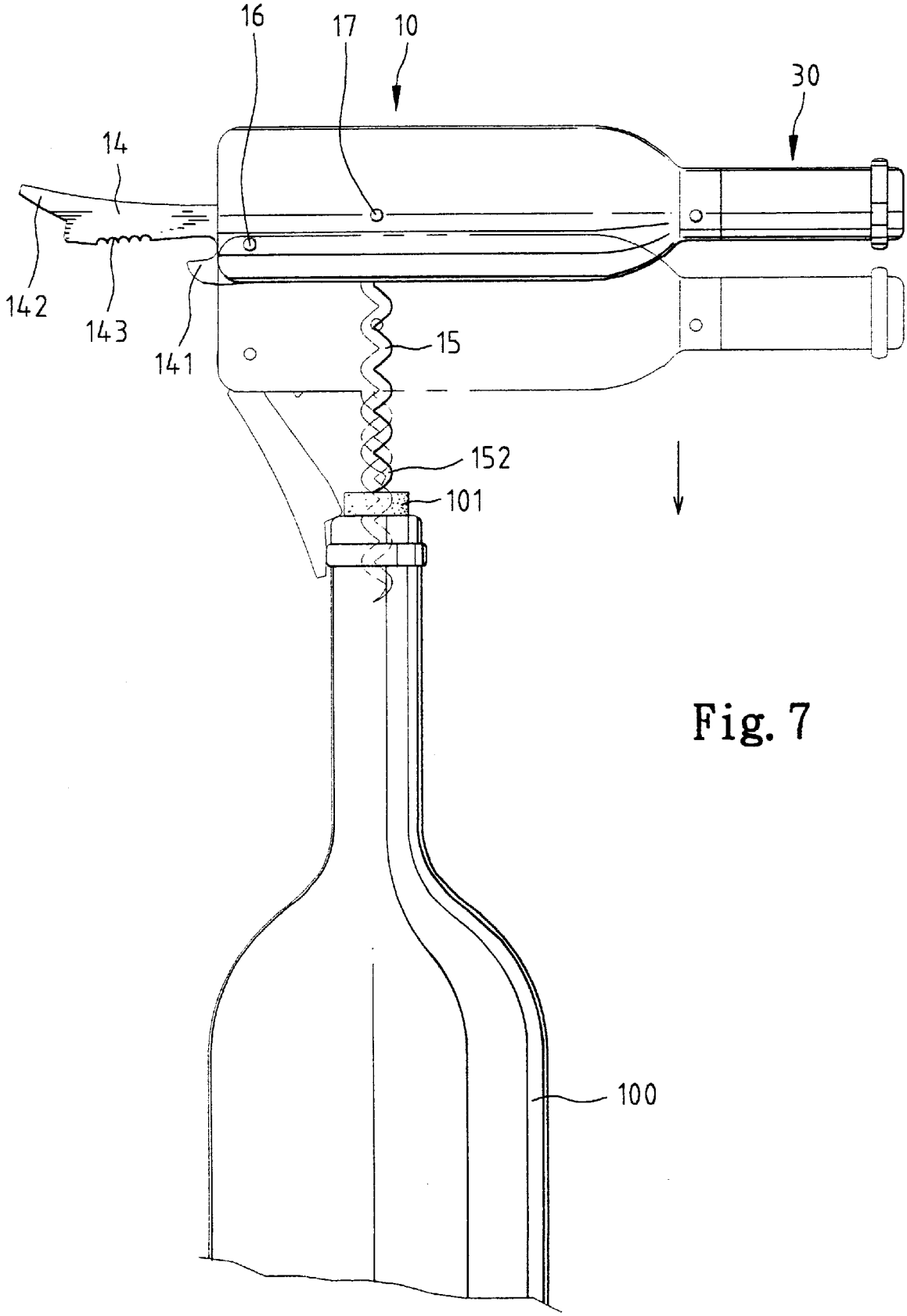
FIGS. 7 and 8 illustrates operation of the cork remover, wherein in FIG. 7 the corkscrew of the cork remover is pierced into the cork, and in FIG. 8 the tool holder is swiveled to remove the cork.
Figure 8:
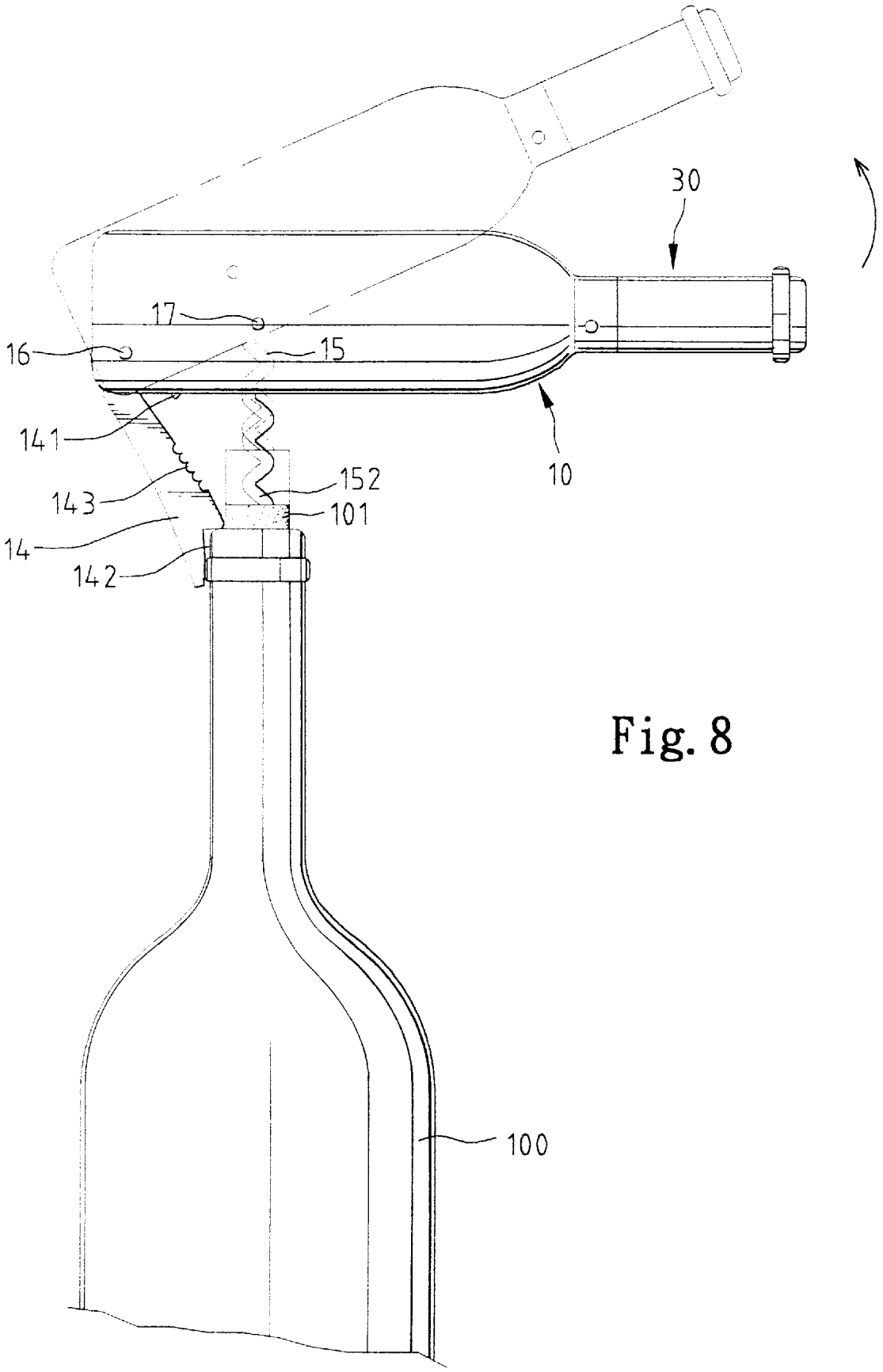

A bit 50 may be removed from the bit holding plate 40 (after removing the bit holding plate 40 from the compartment 11) and then inserted into the bit holder 20 and thus retained in place by the spring 22, as shown in FIG. 4. Thus, the tool holder may act as a handle for a tool (e.g., a screwdriver), best shown in FIG. 5. In addition, the corkscrew 15 and the stopper 14 may be pivoted to their operative positions, as shown in FIG. 6. Referring to FIG. 7, the second end 152 of the corkscrew 15 is pierced into a cork 101 of a wine bottle 100 or the like. Then, the end 142 of the stopper 14 is made to bear against the mouth (not labeled) of the wine bottle 100 and thus allow removal of the cork 101 by means of swiveling the tool holder (FIG. 8), which is conventional and therefore not described in detail.

According to the above description, it is appreciated that the tool holder of the present invention may receive the cork remover (including the corkscrew 15 and the stopper 14) when not in use to prevent injury to children and users. In addition to provide an aesthetically pleasing effect, the tool holder may act as a handle of a tool, while the bits are received in the tool holder when not in use.

Although the invention has been explained in relation to its preferred embodiment, it is to be understood that many other possible modifications and variations can be made without departing from the spirit and scope of the invention as hereinafter claimed.

What is claimed is:

1. A tool combination comprising:

a main body including a recess defined therein, the main body further including a bit holder formed on an end thereof;

a cap removably mounted to the end of the main body to house the bit bolder;

a corkscrew pivotally connected to the main body and movable between a storage position in the recess and an operative position outside the recess; and a stopper pivotally connected to the main body and movable between a storage position in the recess and an operative position outside the recess.

2. The tool combination as claimed in claim 1, wherein the bit holder includes a hexagonal hole defined therein.

3. The tool combination as claimed in claim 2, wherein an inner periphery defining the hexagonal hole includes two aligned grooves, and further comprising a U-shaped spring with two limbs received in the grooves for retaining said at least one bit in the hexagonal hole.

4. The tool combination as claimed in claim 1, wherein the main body includes a fixed seat having a pivotal section for pivotally engaging with an end of the corkscrew.

5. The tool combination as claimed in claim 4, wherein the pivotal section of the fixed seat includes two spaced plates for pivotally sandwiching the end of the corkscrew.

6. The tool combination as claimed in claim 1, wherein a wall defining the compartment includes a pair of groove tracks defined therein, and wherein the bit holding plate includes two extended edges slidably received in the groove tracks.

7. The tool combination as claimed in claim 1, wherein the main body includes a threaded section, and wherein the cap includes a receptacle having an inner threading for engaging with the threaded section of the main body.

8. The tool combination as claimed in claim 1, wherein the main body includes a compartment, farther comprising a bit holding plate removably received in the compartment of the main body and releasably holding a plurality of different bits, one of said bits to be used being releasably held in place by the bit holder.

* * * * *